US009565982B2

(12) United States Patent
Stein

(10) Patent No.: US 9,565,982 B2
(45) Date of Patent: Feb. 14, 2017

(54) FLOOR CARE APPLIANCE

(71) Applicant: Stein & Co. GmbH, Velbert (DE)

(72) Inventor: Thomas Stein, Velbert (DE)

(73) Assignee: Stein & Co. GmbH, Velbert (DE)

( * ) Notice: Subject to any disclaimer, the term of this patent is extended or adjusted under 35 U.S.C. 154(b) by 101 days.

(21) Appl. No.: 14/704,009

(22) Filed: May 5, 2015

(65) Prior Publication Data

US 2015/0313429 A1 Nov. 5, 2015

(30) Foreign Application Priority Data

May 5, 2014 (DE) ..... 10 2014 006 983
Jun. 6, 2014 (DE) ..... 10 2014 008 441

(51) Int. Cl.

*A47L 5/30* (2006.01)
*A47L 9/04* (2006.01)
*A47L 9/32* (2006.01)
*A47L 9/12* (2006.01)

(52) U.S. Cl.

CPC ..... *A47L 9/0411* (2013.01); *A47L 5/30* (2013.01); *A47L 9/0477* (2013.01); *A47L 9/12* (2013.01); *A47L 9/122* (2013.01); *A47L 9/325* (2013.01)

(58) Field of Classification Search

CPC ..... A47L 5/30; A47L 9/0411; A47L 9/122; A47L 9/12; A47L 9/325; A47L 9/0477
USPC ..... 15/350, 351
See application file for complete search history.

(56) References Cited

U.S. PATENT DOCUMENTS 5,228,169 A 7/1993 Stein et al.
5,946,771 A 9/1999 Bosyj et al.

FOREIGN PATENT DOCUMENTS

DE 9104750 6/1991

OTHER PUBLICATIONS

US 6,266,845, 07/2001, Lang (withdrawn)
German Search Report, Jun. 6, 2014.

*Primary Examiner* — David Redding
(74) *Attorney, Agent, or Firm* — Greer, Burns & Crain Ltd.

(57) ABSTRACT

A brush vacuum cleaner having a brush set for receiving a driven brush roller, wherein at least one electric motor for a suction fan and for the drive of the brush roller is disposed in the brush set and wherein at least three air guiding channels are formed in a pivotable connecting element between the brush set and a filter housing. A supply of the dirt-laden suction air from the brush set to the filter housing takes place through the first air guiding channel, the filtered air is returned to the brush set through the second air guiding channel and through the third air guiding channel exhaust gas of the suction fan is returned to the filter housing to an air outlet.

6 Claims, 4 Drawing Sheets

FLOOR CARE APPLIANCE

CROSS-REFERENCES TO RELATED APPLICATIONS

This application claims the benefit of German patent application No. 10 2014 008 441.8 filed on Jun. 6, 2014, and of German patent application No. 10 2014 006 983.4 filed on May 5, 2014, the entire disclosures of which are incorporated herein by way of reference.

BACKGROUND OF THE INVENTION

The invention relates to a floor care appliance in the form of a carpet cleaning appliance in the form of a brush vacuum cleaner having a brush set facing the floor for receiving a driven brush roller, where the brush set can be connected by means of a pivotable connecting element having air guiding channels, in the form of a connecting piece for an attachable filter housing, to a handle in the form of a hand grip via corresponding connections and the brush set accommodates at least one electric motor for a suction fan and for the drive of the brush roller and the air guiding channels of the pivotable connecting element are guided for supplying the dirt-laden air from the brush set to the filter housing and returning the filtered air via a parallel air guiding channel to the brush set and air is exhausted from the suction fan via discharge openings.

In appliances of this type, there is a requirement to supply the exhaust air from the suction fan via relatively expensive filter elements to a discharge opening. For this purpose it is necessary to accommodate filter elements having large dimensions in the appliance. In appliances of the generic type, as a result of the necessary small overall height of the brush set as a flat configuration it is not possible to accommodate a functional filter of the required size without bringing about an impairment of the suction work to be carried out underneath items of furniture and the like.

Corresponding documentary prior art is disclosed, for example by the applicant himself in DE 91 04 750 U1. DE 91 04 750 U1 discloses a brush vacuum cleaner with a pivotable connection between a filter housing and a brush set. In this case the suction fan is disposed in the brush set.

Further documentary prior art is known from U.S. Pat. No. 6,266,845 B1 and U.S. Pat. No. 5,946,771.

SUMMARY OF THE INVENTION

It is an object of the invention to enable a relatively large filter element to be arranged in a simple manner in generic floor care appliances without increasing the overall height of the brush set including the existing appliance parts, and to ensure easy accessibility to the filter element.

This object is solved according to the invention whereby the pivotable connecting element has an additional third air guiding channel in the form of an exhaust air channel of the suction fan in the brush set with a supply to a discharge region in the filter housing with an air outlet and an interposed filter.

As a result of this arrangement it is possible to shift the discharge opening with filter into the attachable filter housing and thereby provide a receiving region in the required size.

In one exemplary embodiment, an inflow to the third air guiding channel in the form of an exhaust air channel for exhaust air of the suction fan runs at the front to a contact surface assigned to the suction fan on the connecting element side, which is provided with at least one corresponding opening. The inflow on the suction fan side to the third air guiding channel takes place along a pivot axis of the connecting element whereby an inflow is ensured in each pivot position if the at least one opening is configured accordingly.

In one exemplary embodiment it is provided that the preferred inflow to the third air guiding channel in the form of an exhaust air channel for exhaust air of the suction fan runs through a barrel/jacket-shaped channel located around the fan housing and corresponding openings in the contact surface with seal assigned to the inflow side of the suction fan and through an adjoining chamber in the pivotable connecting element which is sealed towards the air return channel. Naturally other front-side inflows are conceivable, for example by means of a channel separate from the fan housing which opens into an opening of the contact surface.

An advantageous embodiment consists in that the openings in the contact surface with seal assigned to the inflow side of the suction fan are arranged in an annular shape and correspond with a chamber arranged concentrically with seal around the air return channel in the pivotable connecting element as inflow to the exhaust air channel.

It is further proposed that the exhaust air channel as an additional rectangular channel laterally delimits the two further air guiding channels having a circular cross-section.

It is further provided that the discharge region of the filter housing is configured as a filter chamber for receiving a removable particle filter and the air outlet has a screen cover.

DETAILED DESCRIPTION OF THE PREFERRED EMBODIMENTS

Figure 1:
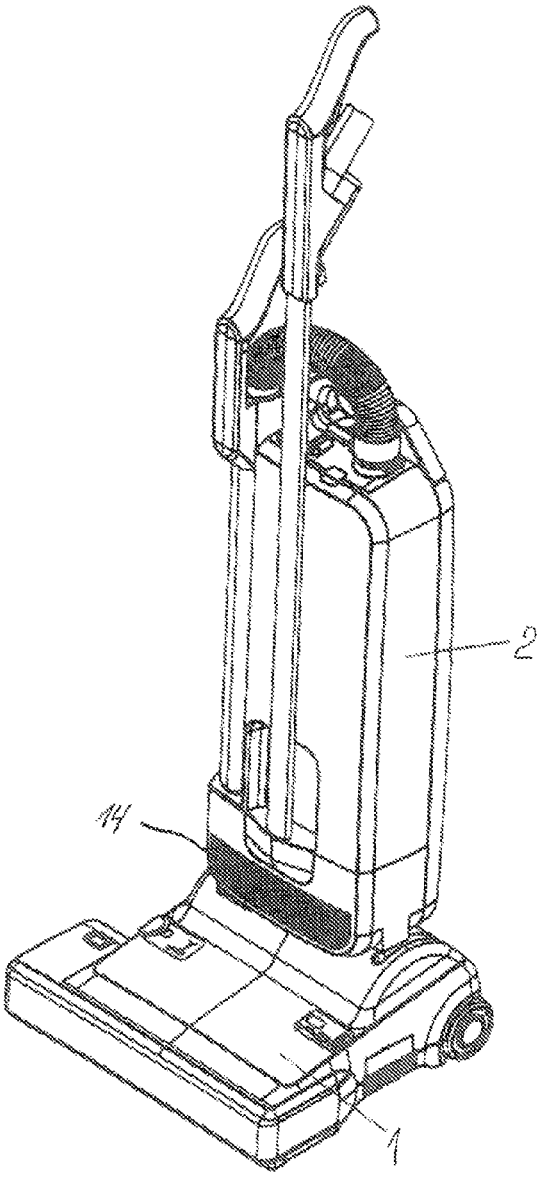
FIG. 1 shows a brush vacuum cleaner with a brush set and a filter housing placed thereon.
Figure 2:
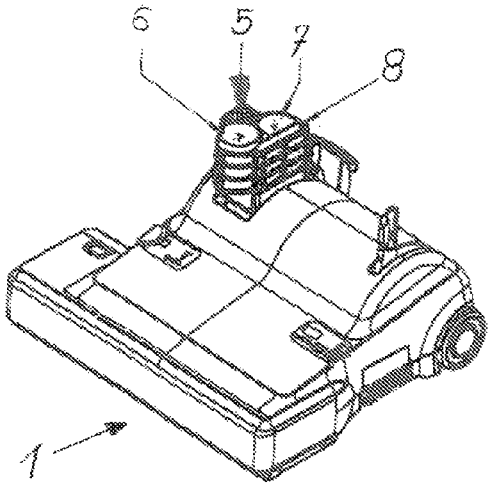
FIG. 2 shows a brush set with a pivotable connecting element as connecting piece.
Figure 3:
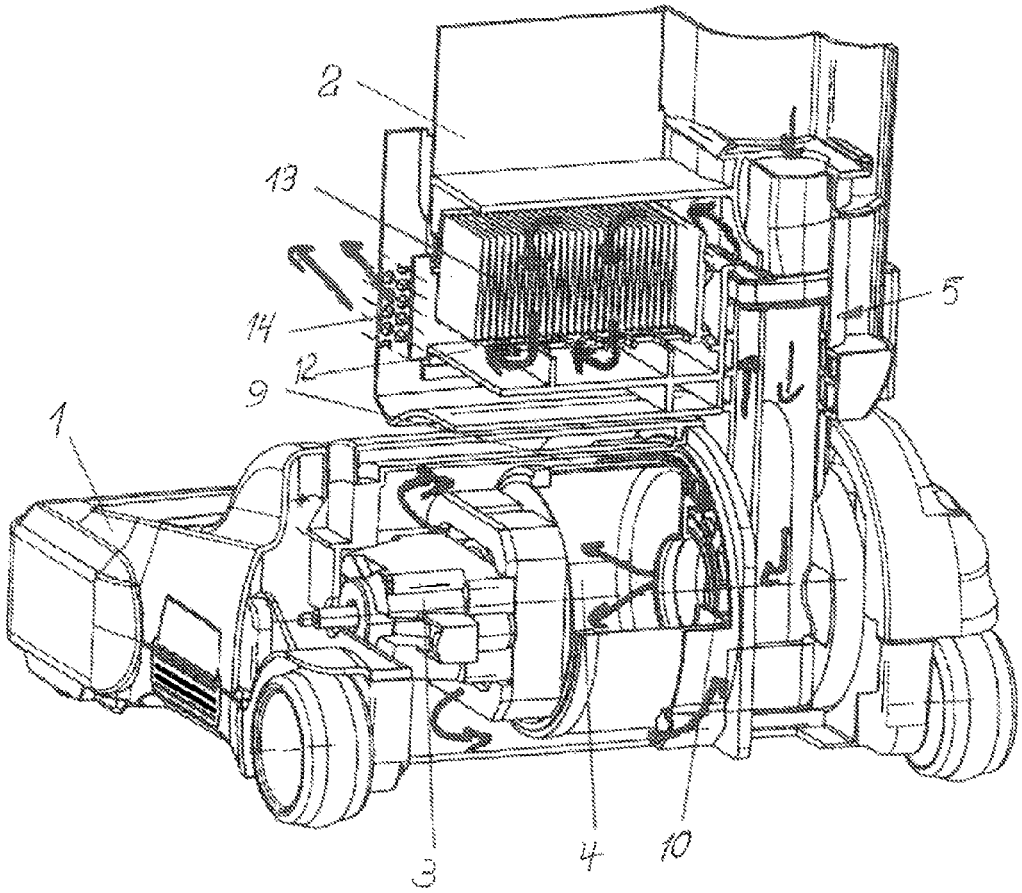
FIG. 3 shows a diagrammatic view with air guidance of the exhaust air of a suction fan in the brush set to the discharge filter in the attached filter housing.
Figure 4:
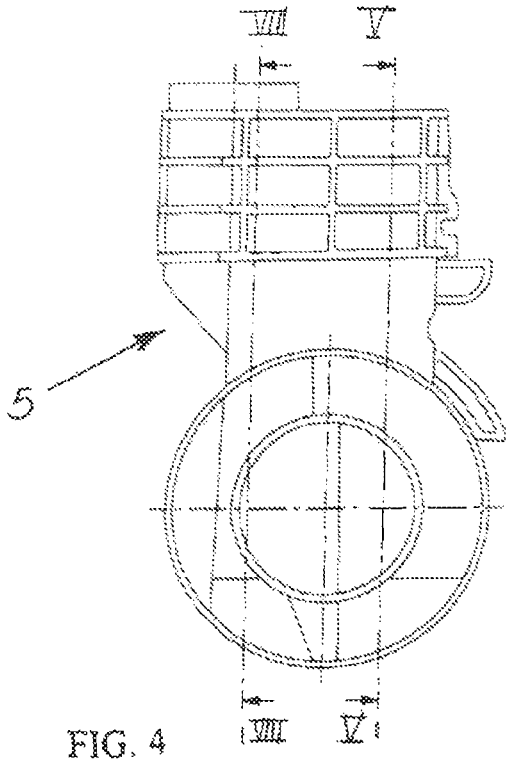
FIG. 4 shows a side view of a pivotable connecting element with air guiding channels.
Figure 5:
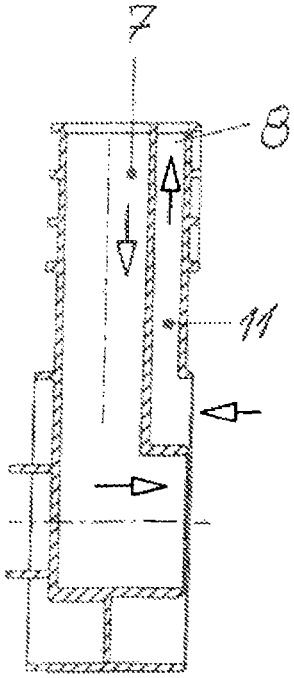
FIG. 5 shows a sectional view according to the line V-V in FIG. 4.
Figure 6:
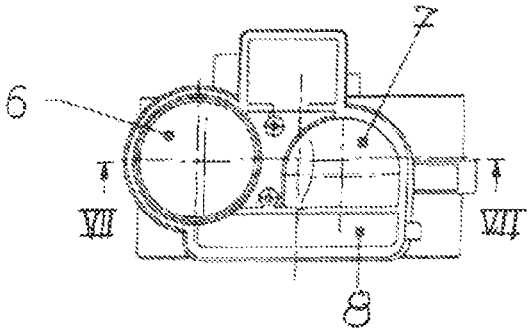
FIG. 6 shows a plan view according to FIG. 4.
Figure 7:
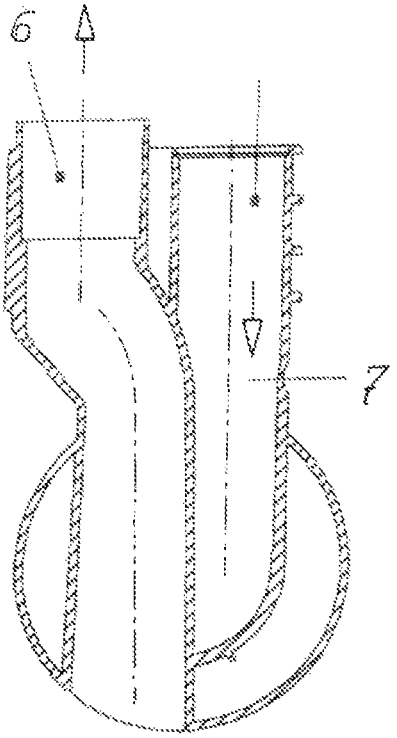
FIG. 7 shows a sectional view according to the line VII-VII in FIG. 6
Figure 8:
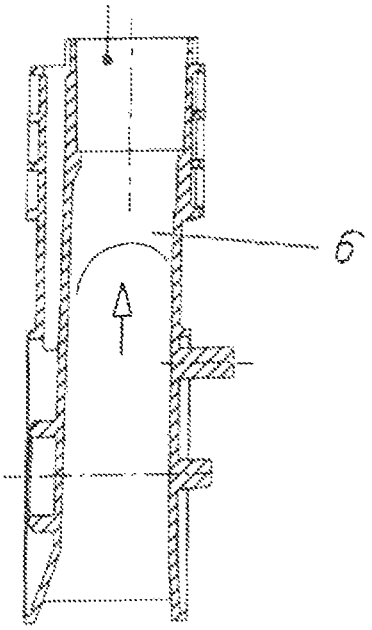
FIG. 8 shows a sectional view according to the line VIII-VIII in FIG. 4.

The brush vacuum cleaner shown comprises a brush set 1 and an attachable filter housing 2 with a handle, where the brush set 1 has a motor 3 for a suction fan 4 and a brush roller not shown in detail. The connection between brush set 1 and filter housing 2 is made by means of a pivotable connecting element 5 with air guiding channels 6, 7 and 8 as connecting pieces.

The air guiding channels 6, 7 and 8 are connected correspondingly to associated further channels in the filter housing 2 by the connection of the connecting element 5 and are continued independently of the pivoting movement of the connecting element 5. The air guiding channel 6 is used in a known manner for supplying the dirt-laden suction air from the brush set 1 to the filter housing 2 and the filtered air is returned via the air guiding channel 7 to the brush set 1.

A third air guiding channel in the form of the exhaust air channel 8 of the pivotable connecting element 5 is provided for the exhaust air of the suction fan 4.

The inflow to the third air guiding channel in the form of the exhaust air channel 8 for the exhaust air of the suction fan 4 takes place at the front (inlet side of the suction fan) to a contact surface associated with the suction fan 4 on the connecting element side, which is provided with at least one corresponding opening 10. In the exemplary embodiment shown here the front-side inflow takes place through a jacket-shaped channel 9 arranged around (surrounding) the fan housing and corresponding openings 10 in the contact surface assigned to the inflow surface of the suction fan 4 and an upstream chamber 11 through the air guiding channel 8 in the pivotable connecting element 5 with associated seals.

The exhaust air channel 8 leads to a filter chamber 12 in the attached filter housing 2 with an inserted particle filter 13 and an air outlet 14 which in this case has a screen cover.

Disclosed is a brush vacuum cleaner having a brush set for receiving a driven brush roller, wherein at least one electric motor for a suction fan and for the drive of the brush roller is disposed in the brush set and wherein at least three air guiding channels are formed in a pivotable connecting element between the brush set and a filter housing and a supply of the dirt-laden suction air from the brush set to the filter housing takes place through the first air guiding channel, the filtered air is returned to the brush set through the second air guiding channel and through the third air guiding channel exhaust gas of the suction fan is returned to the filter housing to an air outlet.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a carpet cleaning appliance in the form of a brush vacuum cleaner having a brush set facing the floor for receiving a driven brush roller, comprising:

a handle in the form of a hand grip;

an attachable filter housing attached to the handle via corresponding connections;

a pivotable connecting element having air guiding channels connecting the brush set and the attachable filter housing;

the brush set accommodating at least one electric motor for a suction fan and for the drive of the brush roller;

a first of the air guiding channels of the pivotable connecting element being configured to supply dirt-laden air from the brush set to the filter housing and a second, parallel one of the air guiding channels being configured to return filtered air to the brush set; and at least one discharge opening located in the brush set configured to exhaust air from the suction fan;

the pivotable connecting element having an additional third air guiding channel in the form of an exhaust air channel communicating with the discharge opening of the suction fan exhaust air and configured to supply the exhaust air to a discharge region in the filter housing having an air outlet and an interposed filter.

2. The floor care appliance according to claim 1, wherein an inflow to the third air guiding channel is located at an inlet side of the suction fan through a contact surface for the suction fan, the contact surface being provided with at least one corresponding opening.

3. The floor care appliance according to claim 2, wherein the inflow to the third air guiding channel runs through a jacket-shaped channel surrounding the fan housing and corresponding openings in the contact surface with a seal assigned to the inflow side of the suction fan and through an adjoining chamber in the pivotable connecting element which is sealed from the air return channel.

4. The floor care appliance according to claim 3, wherein the at least one opening in the contact surface with seal assigned to the inflow side of the suction fan comprise a plurality of openings arranged in an annular shape and correspond with a chamber arranged concentrically, with a seal, around the air return channel in the pivotable connecting element as an inflow to the exhaust air channel.

5. The floor care appliance according to claim 1, wherein the exhaust air channel is formed as an additional rectangular channel laterally positioned relative to the first and second air guiding channels, which are each formed with a circular cross-section.

6. The floor care appliance according to claim 1, wherein the discharge region of the filter housing is configured as a filter chamber for receiving a removable particle filter and the air outlet has a screen cover.

* * * * *